United States Patent [19]

Wieland

[11] 4,202,587

[45] May 13, 1980

[54] CONTAINER WITH REPLACEABLE SECURITY LOCK FOR STORAGE OF INFORMATION CARRIERS

[75] Inventor: Jakob Wieland, Oberweningen, Switzerland

[73] Assignee: Bauer Kassenfabrik AG, Switzerland

[21] Appl. No.: 887,970

[22] Filed: Mar. 17, 1978

[30] Foreign Application Priority Data

Mar. 30, 1977 [CH] Switzerland ..... 3986/77

[51] Int. Cl.[2] ..... E05B 65/46

[52] U.S. Cl. ..... 312/219; 70/368

[58] Field of Search ..... 70/85, 86, 448, 449, 70/451, 368; 312/219, 333, 218; 292/241

[56] References Cited

U.S. PATENT DOCUMENTS

| | | | |
|---|---|---|---|
| 1,761,092 | 6/1930 | Shinn | 70/368 |
| 1,969,011 | 8/1934 | Jacobi | 70/368 |
| 2,012,996 | 9/1935 | Jacobi | 70/368 |
| 3,402,582 | 9/1968 | Jacobi | 70/368 |

*Primary Examiner*—Kenneth Dorner

*Attorney, Agent, or Firm*—Roylance, Abrams, Berdo & Farley

[57] ABSTRACT

A storage container in a piece of office furniture, such as a desk, is provided with a security lock which can be removed and replaced with another lock only by means of the original key for the lock. A releasable catch mechanism holds the lock housing firmly in a receiving well for the lock. Access to the catch is blocked by a covering member which can be moved away from its covering position only by movement of the lock mechanism with the original key. Thereupon, the catch can be released and the lock pulled out of its receiving well.

7 Claims, 15 Drawing Figures

R47
A3
XIV
XIII
XV
X

CONTAINER WITH REPLACEABLE SECURITY LOCK FOR STORAGE OF INFORMATION CARRIERS

BACKGROUND OF THE INVENTION

The invention relates to a security container, or receptacle for information carriers which are to be kept secret, and in particular to security office furniture with a demountable lock.

Information carriers, such as e.g. technical drawings, plans, files, films, photographs, models, samples, tapes, EDP, data carriers and the like, which are to be kept secret and which are therefore stored in specially designed receptacles, specifically security office furniture, such as e.g. filing cabinets, cabinets with drawers or hanging charts, security desks, etc. are increasingly exposed to espionage, which may be commercial espionage i.e. industrial or factory espionage, or political espionage.

Unlike the danger to which articles of value such as e.g. money, jewelry or other valuable effects, such as paintings deposited in safes, are exposed due to theft, burglary, or even robbery, it is characteristic of espionage activities that the information carriers, e.g. design drawings which have to be maintained secret, are only temporarily removed by the spy from the receptacle in question, e.g. a cupboard for plans and drawings equipped with drawers, and are then returned to the receptacle after the making of copies, e.g. photographs or photocopies, or after merely memorization of the data of interest. It is also characteristic of the work of professional spies that unlike when breaking into a safe, they in no way damage or destroy the security receptacle in question, i.e. they leave behind no visible marks, and the act of espionage remains undetected by the interested parties. This is mainly because espionage generally extends over a long period, i.e. it is repeated several times at the same place.

Therefore, as a defense against spies, i.e. the unnoticed opening and closing of the receptacle by third parties, the preferably steel housing members of security office furniture are not screwed or even assembled together, but are instead welded together from the inside, such as e.g. the covers and bottoms to the drawer sets and the drawer fronts to the drawers, in order to prevent the temporary theft of secret articles without leaving behind visible marks. In addition, in the known security office furniture the locking bars are secured against bending by being given generous cross-sectional dimensions and positive guidance with multiple close mounting. However, in the case of the known means, the possibility often exists of raising them into their opening or unlocking position with the furniture closed and locked by inserting a disc into a crack or gap in the furniture or by inserting a thin metal rod into a relatively small, and therefore unnoticed, hole made by drilling laterally into the drawer set. Another possibility is to turn the office furniture upside down, whereby the locking bars drop into the unlocking position due to their own weight.

However, the very real danger which exists with the hitherto known security office furniture with interchangeable locks is that a spy disguised as a customer, supplier or service engineer for the telephone or central heating companies, or even a member of staff, is able to replace the original lock, which is generally a complicated cylinder lock, by a specially prepared lock during a brief absence of the person in charge, since the furniture generally is left open during office hours. The original key held by the authorized person and the key held by the spy will then fit into the new lock. It is then possible for the spy or his accomplice to open his specially prepared lock and carry out his spying during subsequent visits even if the office furniture happens to be closed and locked.

BRIEF SUMMARY OF THE INVENTION AND EMBODIMENTS

An object of the invention is to obviate the above disadvantages and provide an espionage-proof receptacle for information carriers which are to be kept secret, particularly security office furniture with a demountable lock, whereby it is no longer possible for a spy to replace the original lock unnoticed, i.e. without leaving behind visible marks, and fit a specially prepared lock, and whereby it is also no longer possible to raise the locking bars into their unlocked position after laterally drilling the piece of furniture or to lower them into this position by turning the furniture upside-down.

With the novel receptacle in accordance with the present invention the lock can only be dismantled from the receptacle by using the associated key. A securing member connected with a lock part which is only movable by means of the key. The securing member, together with a releasable catch for the lock housing, serves as a dismantling preventing means and, when the receptacle is open, covers the releasable catch movably arranged in the lock housing. In its locking position, it engages in a fixed part of the receptacle, and thus secures the lock in its fitted position in the fixed part of the receptacle against unauthorized damage-free dismantling. It can only be moved from its covering position over the locking member by movement of the lock part, and only then can the releasable catch, which has been made accessible, be moved out of its locking position in the fixed part of the receptacle and the lock be removed therefrom.

According to a preferred embodiment of the novel receptacle in accordance with the invention, the stator of the lock constructed as a cylinder lock detachably inserted in the fixed part of the receptacle in bayonet catch-like manner can be secured against turning back in its locking turning position by the engagement of the releasable catch in the fixed part of the receptacle, a protective wing serving as the securing member, connected with the rotor of the cylinder lock and non-rotatable relative to the latter, covers the releasable catch located in its locking position in the key removal rotation position of the rotor and can only be turned from its covering rotation position by rotation of the rotor. The releasable catch only becomes accessible after such rotation of the rotor and can only then be moved back from its locking engagement in the fixed part of the receptacle. Only after movement of the releasable catch from its locking position can the stator of the cylinder lock be rotated back from its locking rotation position and subsequently removed from the fixed part of the receptacle.

According to a further preferred embodiment of the receptacle according to the present invention, at least one locking bar provided for locking drawers or venetian blind-like closing means for a receptacle constructed as security office furniture in their locking position can itself be locked. A cam disc which is arranged on an operating shaft. The cam disc is non-rotatable relative to the shaft. The shaft is detachably connected by means of an attachment with a rotor shoulder of the cylinder lock and has a nose-like projection which in the latter part of the locking rotary movement of the cam disc is positioned over an operating pin constantly engaging on the lifting cam of the cam disc and fixed to the locking bar. During the latter part of the locking rotary movement of the cam disc the operating pin enters the one-sided open recess of the rotary cam disc which is limited by the lifting cam on one side and by the edge of the cam disc projection on the other.

BRIEF DESCRIPTION OF THE DRAWINGS

The invention is described in further detail hereinafter relative to embodiments and with reference to the attached drawings, showing.

DETAILED DESCRIPTION OF THE PREFERRED EMBODIMENTS

Figures 1, 2, 3, 4, 5, 6, 7:
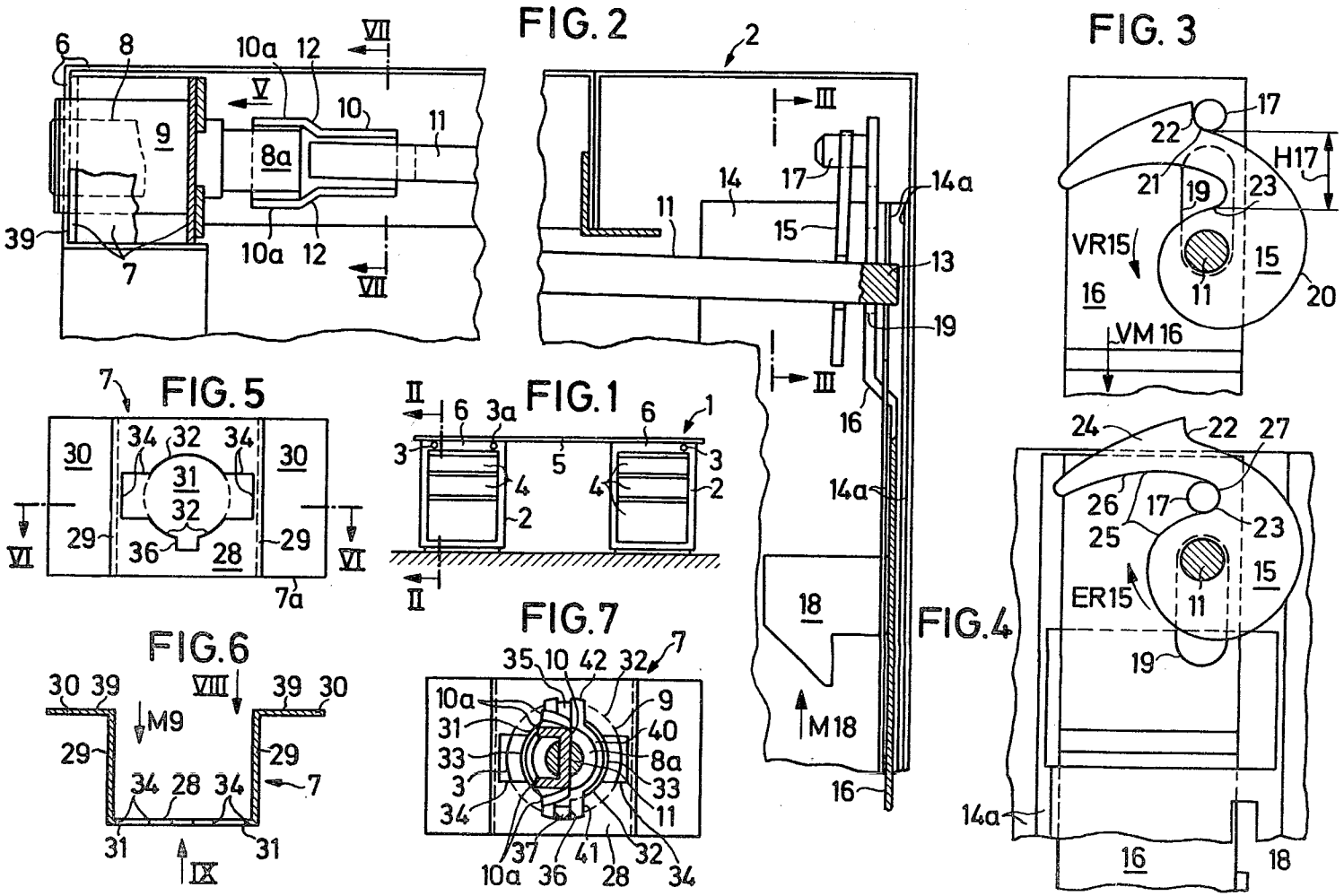
FIG. 1 a front view of a desk provided with a receptacle in accordance with a preferred embodiment of the present invention.
FIG. 2 the upper part of the left-hand drawer set of the desk of FIG. 1 in vertical section along the line II—II of FIG. 1.
FIG. 3 the operating shaft and locking rod of the drawer set of FIG. 2 in the open position in a vertical section along the line III—III of FIG. 2.
FIG. 4 the operating shaft and locking rod of the drawer set of FIG. 2 in the closed position in a vertical section corresponding to FIG. 3.
FIG. 5 a fixed part of the receptacle of the desk of FIG. 1 for receiving the replaceable cylinder lock of FIG. 1 in plan view as seen from the location indicated by arrow V of FIG. 2.
FIG. 6 the fixed part of the receptacle of FIG. 5 in a cross-section along the line VI—VI of FIG. 5.
FIG. 7 the fixed part of the receptacle with a cylinder lock inserted therein and the attachment between the lock rotor and the operating shaft of FIG. 2 in vertical section along the line VII—VII of FIG. 2.

In FIG. 1 there is shown a sheet steel desk 1 designed as security office furniture. It has two drawer sets 2, each being provided with a demountable cylinder lock 3. Each lock serves for the simultaneous locking and unlocking of all the drawers 4 of the associated set 2 and is incorporated from the inside into a drawer set cover 6, which is welded to the drawer set 2 or is bevelled thereon in one piece. For space-saving reasons, the lock can only be disassembled from the particular set 2 when all the drawers 4 have been removed therefrom, and for this it is necessary to use the original key 47 (cf. FIGS. 12 and 15) which fits lock 3 in the manner to be described in greater detail hereinafter.

FIG. 2 diagrammatically shows the upper part of the left-hand drawer set 2 of FIG. 1 in vertical section along the line II—II of FIG. 1. Lock 3 with its cylindrical stator 9 is demountably inserted in a receptacle receiving well part 7, which is inserted from the rear into drawer set cover 6 and is welded thereto, i.e. is fixed. The rotor 8 of cylinder lock 3, which with a cylindrical shoulder 8*a* projects from the lock stator 9, is connected continuously by an attachment 10 to the key bolt operating shaft 11. In this case, the attachment 10 comprises a twice longitudinally bevelled, cross-sectionally continuous U-shaped sheet metal portion inserted into aligned diametral slits of the rotor shoulder 8*a* and the operating shaft 11. The differing external diameters of rotor shoulder 8*a* and operating shaft 11 are in this case bridged by bends 12 in the two legs 10*a* of the U-shaped attachment 10. The rearwardly, slightly downwardly inclined operating shaft 11 is pivoted at its rear end by means of a pivot 13 in a vertical fixed plate 14 of substantially rectangular cross-section. A cam plate 15, which is placed on shaft 11 and is welded thereto, serves to operate a vertically directed locking bar 16 which is vertically displaceably guided in a bend of the rear leg of the angular plate 14. During its rotation, shaft 11 acts by means of cam plate 15 on a pin 17 which is fixed to the upper end of locking bar 16. In FIG. 2 locking bar 16 is raised by cam plate 15 (cf. also FIG. 3) and is located in its unlocking position, in which its hook-like bolts 18 for the drawers 4 (cf. FIG. 1) arranged in vertically superimposed manner in a system corresponding to the drawer height project through vertical slots of the bent rear portion of plate 14 and are raised out of the associated recesses of drawers 4 (cf. FIG. 1) in the direction of arrow M18. The rotor 8 of cylinder lock 3, as in the lower locking position of locking bar 16 (cf. FIG. 4), is in its key removal rotation position and the key channel, arranged somewhat eccentrically in rotor 8, extends vertically and points rearwards (cf. FIG. 8). Operating shaft 11 with its pivot 13 passes through a vertical slot 19 of the bent upper portion of locking bar 16, so that the latter is movable vertically upwards or downwards within slot 19.

Figures 8, 9, 10, 11, 12, 13, 14, 15:
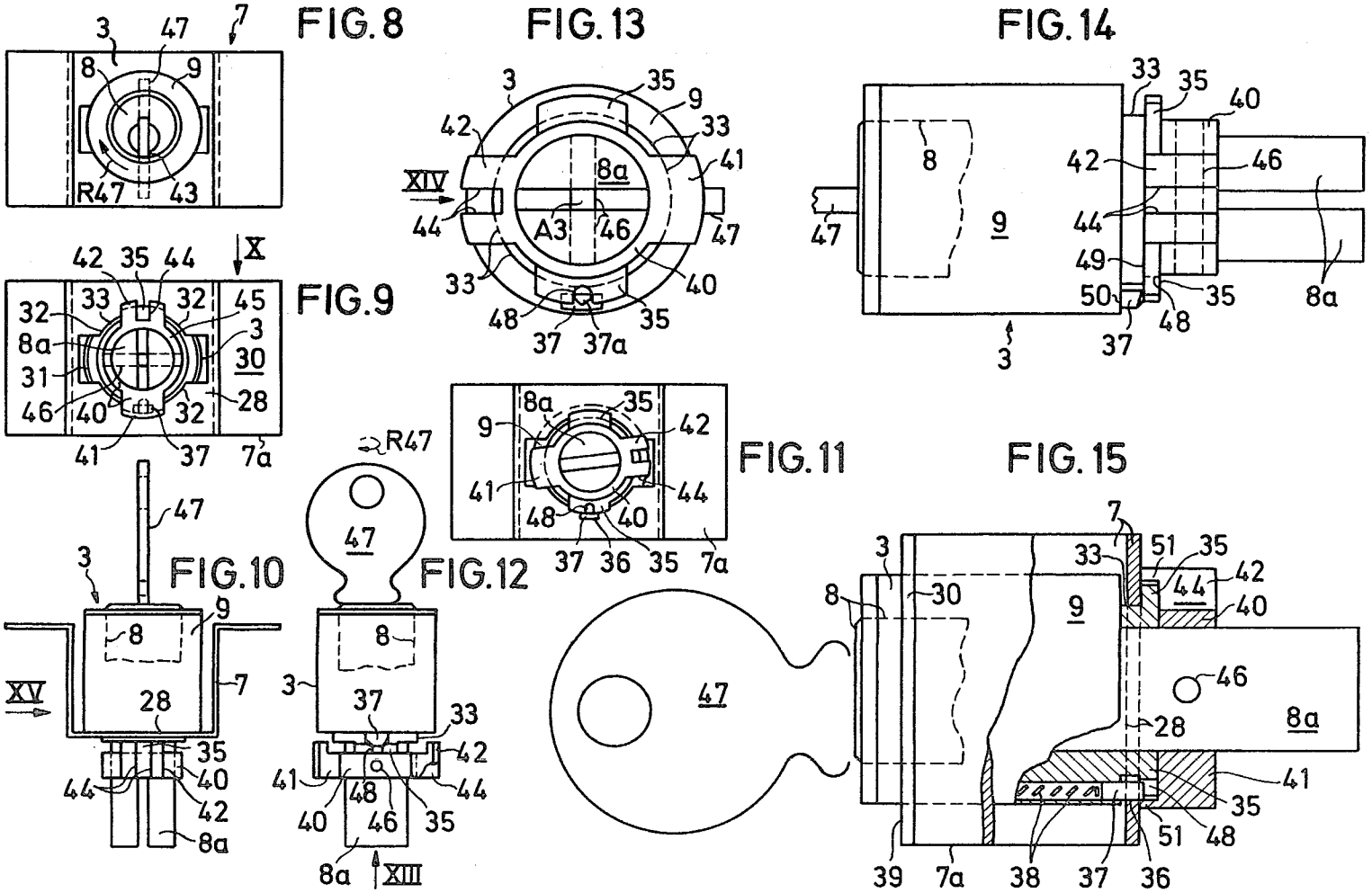
FIG. 8 the fixed part of the receptacle of FIG. 6 with a cylinder lock according to FIG. 2 inserted therein in the front view in accordance with the arrow VIII of FIG. 6.
FIG. 9 the part of the receptacle with the inserted lock of FIG. 8 in rear view in accordance with the arrow IX of FIG. 6.
FIG. 10 the part of the receptacle with the lock and inserted but with an unturned key according to FIG. 9 in plan view as seen from the location indicated by arrow X of FIG. 9.
FIG. 11 the part of the receptacle with the lock of FIG. 9 in the same rear view as in FIG. 8, but with protective wings turned out of the covering position over the locking pin.
FIG. 12 the demountable cylinder lock of FIG. 2 with the inserted key turned by 90 degrees in a view from below.
FIG. 13 the lock with key according to FIG. 12 in its installed position on a larger scale compared with FIG. 12 as viewed from the rear in accordance with the arrow XIII of FIG. 12.
FIG. 14 the lock with the key according to FIG. 13 in a side view in accordance with the arrow XIV of FIG. 13.
FIG. 15 the stationary part of the receptacle with lock and key according to FIG. 10 on a larger scale compared with the latter and in a side view in accordance with arrow XV thereof, partly in vertical longitudinal section.

FIG. 3, like FIG. 2, shows cam plate 15 in the opening rotation position, in which the locking bar 16 via its pin 17 is raised into the unlocking position. Cam 20 of cam plate 15 is in this case constructed in the manner of an archimedes' spiral, and at its maximum 21 relative to the axis of operating shaft 11 passes into an outwardly curved cam plate portion 22 corresponding to the circumference of pin 17 of locking bar 16 to form a stop pin 17 for limiting the opening rotary movement of cam plate 15, shaft 11, rotor 8 and therefore also the key inserted in key channel 43 of the rotor (cf. FIG. 8). While the upper unlocking position of pin 17, and consequently locking bar 16, is determined by the maximum 21 of cam 20, its minimum 23 defines the lower locking position of pin 17 and bar 16 (cf. FIG. 4). In its unlocking rotary position, the maximum 21 of cam 20 is located perpendicularly above the minimum 23, whereby the distance H17 between 21 and 23 forms the unlocking or locking travel of pin 17 and therefore of the locking bar 16. Thus, a complete 360° rotation of cam plate 15, shaft 11, rotor 8 and, consequently, also the key is necessary in order to move the locking bar 16 out of its lower locking position or conversely into the upper unlocking position. Since after the locking of the desk drawers 4 (cf. FIG. 1) the key 47 (cf. FIGS. 12 and 15) must be removable from lock 3 (cf. FIGS. 1 and 2), and since the rotor 8 of the cylinder lock 3 normally only has one key removal rotary position, i.e. for both for locking and unlocking, it must effect a complete 360° rotation by means of the key inserted therein, the key is removable from lock 3 in both the lower locking position of locking bar 16 (cf. FIG. 4) and in the upper unlocking position (cf. FIGS. 2 and 3). Thus, the locking rotary position of rotor 8 is the same as its unlocking rotary position. In this rotor rotation position the key channel 43 of rotor 8 points perpendicularly downwards, as can be seen in FIG. 8. To lock drawer 4, the cam plate 15 effects a 360° rotation in the direction of arrow VR 15.

FIG. 4 shows cam plate 15 and pin 17 of locking bar 16 in the upper locking position. During the 360° rotation of cam plate 15 in the direction of arrow VR 15 (cf. FIG. 3) for locking drawers 4, due to the weight of locking bar 16, pin 17 is followed by the cam 20 moving beneath it, whereby pin 17 and bar 16 move vertically downward. In the latter part of this rotary movement of cam plate 15, a nose-like projection 24 of plate 15 has been moved over pin 17. During the latter part of its downward movement, pin 17 has moved into a recess 25 of the rotary cam plate 15 which is open on one side and is bounded on one side by a cam portion in the area of minimum 23 and on the other side by a curved lower edge 26 of cam plate projection 24. The cam plate portion 23 forms a stop on pin 17 for the unlocking rotary movement of cam plate 15, and therefore also the key (cf. FIG. 3). The base 27 of recess 25 forms a stop on pin 17 for the locking rotary movement of cam plate 15, and consequently the key. In the same way as during unlocking the key 47 together with rotor 8 cannot rotate beyond the unlocking rotary position, on locking the key together with the rotor cannot rotate beyond the locking rotary position. These two rotary rotor positions coincide due to the complete 360° rotation of the key for locking and unlocking purposes, whereby key channel 43 always points downwards (cf. FIG. 8) and the key is always removable. Drawers 4 are unlocked by a 360° rotation of cam plate 15 in the direction of arrow ER 15.

Due to this construction of cam plate 15, locking bar 16 is blocked in its lower locking position, i.e. it is in turn locked by cam plate 15. In conjunction with locking bar pin 17, cam plate projection 24 prevents the raising of locking bar 16 from its locking position into the unlocking position. Therefore, any attempt on the part of a spy to raise the locking bar 16 into its upper position by inserting a thin disc through a gap or crack in desk 1 (cf. FIG. 1) would be unsuccessful. In the same way, this would also be quite impossible for a professional spy, who would obviously have purchased a desk of the same type and would have studied its locking mechanism, i.e. would have had expert knowledge of the locking bar position in the set 2 of drawers (cf. FIG. 1) and of the position where it could best be raised to raise the locking bar 16 into its unlocking position by means of a thin metal rod inserted into a small hole made by drilling into the side of drawer set 2 (cf. FIG. 1). In addition, the method frequently used by spies of turning the furniture upside-down, i.e. completely reversing the desk 1, in this case in order to make the locking bars 16 (in the right-hand drawer set 2 of desk 1) of the same locking mechanism provided in homologous manner (cf. FIG. 1) to drop by their own weight into the unlocking position, would also be unsuccessful.

FIG. 5 shows in a plan view from the rear (relative to the desk) the fixed receptacle well part 7 which is welded within the drawer set cover 6 and in which is inserted lock 3 (cf. FIG. 2). As can be gathered from FIG. 6, receptacle well part 7 comprises a sheet metal portion which is bevelled four times and has a central cross-sectionally U-shaped portion with a base 28 and the two parallel legs 29, as well as two divergent tongues 30 which are joined at their ends are located in a common plane and parallel to base 28. A window-like opening 31 in base 28 serves as a receptacle, i.e. for a bayonet-catch-like detachable attachment of cylinder lock 3 in receptacle part 7, and consequently in the cover 6 of drawer set 2. Circular peripheral portions 32 of window 31 are located on a common circle, indicated by dotted lines in FIG. 5, and serve for the centering of stator 9 of cylinder lock 3, which for this purpose is provided at its rear end with a short cylindrical centering shoulder 33 (cf. FIGS. 12 and 14) in fixed receptacle well part 7. Two diametrically facing, and in this case identical rectangular side portions 34 of window 31 serve for the insertion of two collar-like attachments 35 of stator 9 (cf. FIGS. 11, 13 and 14), which after their insertion and the subsequent rotation of stator 9 by 90° engage in bayonet catch-like manner behind the base 28 of fixed receptacle part 7 and consequently ensure a fixed but detachable connection between lock 3 and drawer set 2 (cf. FIGS. 1 and 2). A relatively small lower rectangular window peripheral portion 36 serves for the engagement of a locking pin 37 (cf. FIGS. 14 and 15) which is spring-mounted in stator 9 and leads to the locking of the latter in its fitted rotary position, i.e. its turning back into the insertion or removal rotary position is prevented. After engaging locking pin 37 in window opening 36, the bayonet catch is locked between stator 9 and receptacle part 7. After insertion of stator 9 into base 28, but prior to its rotation for the purpose of reaching the releasable bayonet catch, the locking pin 37 which projects somewhat at the rear end of stator 9 must be moved back by means of an auxiliary tool into stator 9 and counter to the tension of its spring 38 (cf. FIG. 15), so that the stator can be rotated by 90° in its bayonet catch rotary position, as will be explained in greater detail hereinafter.

Receptacle part 7 is inserted from the inside into the cavity of cover 6 (cf. FIG. 2), with its lower edge 7*a* adjacent to the small window edge opening 36 downwards, opening 36 pointing vertically downwards. With respect to the receptacle well part 7 welded into cover 6, the two flange-like tongues 30 are at the front, relative to desk 1 (cf. FIG. 1), and base 28 is at the rear (cf.

FIG. 2). At the front, the two tongues 30 form two front stop faces 39 (cf. FIG. 6) in a common vertical plane which engage the fixed receptacle part 7 when fitted into cover 6 at the inner wall surface of the vertical frontal cover wall (cf. left-hand side of FIG. 2). Receptacle well part 7, inserted in cover 6, can in its correct installation position be welded at lower edge 7*a* with tongues 30 with the sheet metal sections forming cover 6.

FIG. 6 is a cross-sectional view of receptacle well part 7. The two legs 29 of the U-shaped central portion extend perpendicularly to the planar base portion 28, i.e. are parallel to one-another. The two divergent flange-like tongues 30 are located with their front stop faces 39 in a common vertical plane and are therefore parallel to base 28. The inside spacing between the two legs 29 is such that between the same the stator 9 of cylinder lock 3, with its diametrically facing collar-like attachments 35 (cf. FIG. 11), can be inserted from the front, i.e. in the direction of arrow M9, into the U-shaped central portion of receptacle well part 7, and can then be inserted with its two collars 35 through the two lateral openings 34 of the rear window 31.

FIG. 7 shows the fixed receptacle part 7, with cylinder lock 3 inserted therein from the front, in a plan view from the rear. It is once again possible to see attachment 10 (cf. also FIG. 2), which has a U-shaped cross-section over its entire length. Its two tongue-like legs 10*a* are bent in view of the differing diameters of rotor shoulder 8 and operating shaft 11 (cf. also the two bends 12 in FIG. 2).

FIG. 7 also shows the finished bayonet clasp between stator 9 and fixed receptacle part 7. Its removal is prevented by locking pin 37 of stator 9. This is brought about in the following manner:

On inserting cylinder lock 3 into the fixed receptacle part 7, the two collars 35 of stator 9 (cf. FIGS. 11 and 14) are firstly passed through the two lateral portions 34 of window opening 31 (cf. also FIG. 5). During this insertion movement, the short cylindrical stator attachment 33 (cf. FIG. 12 and 14) was directly inserted into the central portion of window 31 defined by the circular window peripheral portions 32 (cf. FIG. 5) leading to the entering of stator 9 in fixed receptacle part 7. After a forcing back into stator 9 of the locking pin 37, which projects somewhat from the rear face of said stator 9 by using an auxiliary tool, the latter is rotated in the direction of arrow R9 by 90°, whereby the two concomitantly rotating locking collars 39 of stator 9 are placed over the circular window peripheral portions 32 and now engage in bayonet clasp-like manner behind the base 28 of receptacle well part 7. Following the 90° rotation of stator 9, the locking pin 37 spring-mounted therein is engaged in the small window opening 36 of window 31, so that a turning back of stator 9 in receptacle well part 7 is prevented, i.e. the bayonet clasp is locked between stator 9 and receptacle well part 7 so that it cannot become detached.

A securing member 40, which is connected to the shoulder 8*a* of rotor 8 in non-rotary manner relative to the latter in the position shown in FIG. 7 where rotor 8 is in its key removal rotary position, covers the two collars 35 of stator 9 with two diametrically facing protective wings 41, 42, so that the stator is protected from destruction by a spy. At the same time, the downwardly projecting protective wing 41 also covers locking pin 37. Securing member 40 with its protective wing 41, in conjunction with the locking pin 37, serves to prevent the replacement of cylinder lock 3 by a specially prepared cylinder lock. The reason is that member 40 and its protective wing 41 can only be turned from its covering rotary position above locking pin 37 by the rotation of rotor 8 by means of the original key inserted therein, and only then is locking pin 37 exposed so that it can be moved back to disassemble lock 3. Thus, lock 3 can only be dismantled from fixed receptacle well part 7 or desk 1 by means of the associated original key. In order to replace lock 3 by a specially prepared lock, a spy would have to remove by force or destroy the protective wing 41, so that visible marks would be left behind. This is contrary to professional spying, which characteristically remains completely unnoticed.

FIG. 8 shows the fixed receptacle well part 7 in its correct fitting position relative to drawer set cover 6 (cf. FIG. 2), with the cylinder lock 3 inserted therein and fixed in the bayonet catch position by locking pin 37 (not visible in FIG. 8). It is shown in a view from the front, relative to the drawer set 2. Rotor 8 is in its key removal rotary position, key channel 43 pointing vertically downwards. In this case, key 47 (cf. FIGS. 10, 12 and 15) is removed, so that rotor 8 is blocked in stator 9 by the tumbler pins of the lock 3. In this rotor rotary position, locking bar 16 is either in its upper unlocking position (cf. FIGS. 2 and 3) or in its lower locking position (cf. FIG. 4).

FIG. 9 shows receptacle part 7 with cylinder lock 3 in the same position as in FIG. 8 but in rear view. The two diametrically divergent collars 35 of stator 9 (cf. also FIGS. 11 and 14) engage in bayonet clasp-like manner behind base 28 of fixed receptacle well 7, but in FIG. 9 are completely covered by the two protective wings 41, 42 of securing member 40. Only the upper protective wing 42, which has a slot-like peripheral recess 44, makes it possible to see the area of the recess as a relatively small peripheral portion of upper collar 35 located in front of wing 42. Lower collar 35 also has a slot-like peripheral recess 48 (cf. FIGS. 11 and 12), in front of which under the pressure of its spring 38 (cf. FIG. 15) the locking pin 37 engages on lower collar 35 (cf. FIGS. 11 to 15). Since securing member 40 with its lower solid, i.e. slot-less, protective wing 41 completely covers the lower collar 35 provided with slot 48, it also covers slot 48, i.e. the access to locking pin 37. Only if the protective wing 41 is moved out of its covering rotation position (cf. FIGS. 11 to 13) by rotating rotor 8, together with the securing member 40, or if protective wing 42 with its slot 44 is positioned precisely above slot 48 of lower collar 35, is access to the locking pin 37 possible, whereby the latter can be forced back by means of an auxiliary tool and stator 9 can be turned back into its insertion rotary position for the purpose of releasing the bayonet clasp. Then lock 3 can be removed from the fixed receptacle part 7.

According to FIG. 9, securing member 40 has a sleeve-like central portion 45 from which the two protective wings 41, 42 diametrically project away. The bore of portion 45 is mounted on rotor shoulder 8*a* and is connected with the latter is nonrotary and non-displaceable detachable manner by means of a radial locking pin 46.

FIG. 10 shows the fixed receptacle well part 7 with cylinder lock 3 in the same position as in FIGS. 8 and 9 but in plan view. In this case, key 47 is completely inserted in the vertically downwardly directed key channel 43 of rotor 8 (cf. FIG. 8), so that rotor 8, which is in the key removal rotary position in stator 8, can be rotated in one or the other rotation directions by in each case 360°, depending on whether locking bar 16 is in the locking or unlocking position, for the purpose of locking or unlocking drawers 4 (cf. FIG. 1), after which rotor 8 with the inserted key 47 is again in the key removal rotary position shown in FIGS. 8 and 10.

FIG. 10 also shows the cylindrical rotor shoulder 8*a*, securing member 40 with the vertically upwardly projecting protective wing 42 and the continuous slot 44 provided therein. Like the downwardly projecting protective wing 40, protective wing 42 extends up to the base 28 of receptacle 7 and covers the upper collar 35, whereby in FIG. 10 only a relatively small central peripheral portion of collar 35 is visible through slot 44 (cf. also top right-hand side of FIG. 15).

FIG. 11 shows the fixed receptacle well part 7 with cylinder lock 3 inserted therein in the same rear view as in FIG. 9 but with rotor 8 and rotor shoulder 8*a* displaced somewhat out of the key removal rotary position, i.e. with the two protective wings 41, 42 turned out of their covering rotary position above the particular associated collar 35 of stator 9. Thus, the two stator collars 35 are exposed by this rotation of the rotor. As a result, in the case of lower collar 35, the slot-like collar recess 48, which is permanently positioned above the rear end of locking pin 37, is simultaneously exposed because collar 35 is fixed to stator 9 and locking pin 37 is only axially displaceable in stator 9, i.e. does not rotate relative to the latter. At the same time, locking pin 37 has become accessible through collar slot 48 and can in this rotation position of rotor 8 be moved back into stator 9, counter to the pressure of the compression springs 38 (cf. FIG. 15) provided therein, together with securing member 40, by means of an auxiliary tool inserted from the rear into slot 48 (the bent end of a paper clip is sufficient for this purpose), so that the bayonet clasp of stator 9 is unlocked, i.e. it is rotatable for disassembling lock 3.

FIG. 12 shows the disassembled cylinder lock 3 with the inserted key 47, but turned by 90° in the direction of arrow 347 out of the insertion position (cf. FIG. 8) when viewed from below. The 90° rotation of the solid protective wing 41 exposes slot 48, so that locking pin 37 is also accessible from the rear through the exposed collar slot 48. The other protective wing 42 of securing member 40 connected to rotor 8 and provided with slot 44 has exposed the other stator collar 35 (not visible in FIG. 12) due to the 90° rotation of key 47. FIG. 12 also shows the locking split pin or pin 46 (cf. also FIG. 9) by means of which securing member 40 is fixed in non-rotary and non-displaceable manner on the butt end-like rotor shoulder 8*a*.

FIG. 13 shows the disassembled cylinder lock 3 with inserted key 47 on a larger scale than in FIG. 12 and specifically in the same rotation position of rotor 8, rotor shoulder 8*a* and securing member 40 as in FIG. 12, but here viewed from the rear of lock 3 in its correct installation position, i.e. with downwardly directed locking pin 37. FIG. 13 also shows the cylindrical centering attachment 33 of stator 9, which in this case is covered at four points by the two stator collars 35 and the two protective wings 41, 42. The downwardly directed locking pin 37 engages in resilient manner on the front face of lower collar 35 in front of slot 48 and on its free rear end is provided with an engaging surface 37*a* (cf. also FIG. 12) which is inclined downwards towards the longitudinal axis A3 of lock 3. As a result, an outward slipping of the wire-like auxiliary tool is prevented on inserting the latter into slot 48 and on mounting the same on the free rear face of locking pin 37.

FIG. 14 shows the dismantled lock 3 with inserted key 47 in the rotary position of rotor 8, according to FIG. 13, in the correct installation position, but in side view. FIG. 14 clearly shows that the two locking collars 35 are positioned immediately behind the cylindrical centering attachment 33 of stator 9, i.e. are fitted onto the said attachment and subsequently milled out or slotted on their two straight parallel peripheral surfaces. In the installation position of lock 3, locking pin 37 is located at the bottom in stator 9 and, as indicated hereinbefore, under the tension of its spring 38 (cf. FIG. 15) engages resiliently on the vertical front face 49 of lower collar 35. On assembling lock 3, locking pin 37 is forced back by means of the auxiliary tool inserted through collar slot 48, making it possible to rotate into its bayonet clasp rotary position the stator 9, which was previously inserted through the window 31 into receptacle well part 7 until its rear end face 50, which serves as a stop face, engages on the base 28 of fixed receptacle 7, whereby locking pin 37 engages in the small opening 36 of window 31 in a resilient manner so that detaching of the bayonet clasp is prevented (cf. FIGS. 7 and 9).

FIG. 15 shows in side view and partly in vertical longitudinal section the fixed receptacle well part 7 with fitted cylinder lock 3 and inserted but not turned key 47. The horizontal portion 7*a* of receptacle 7 adjacent to the small opening 36 of window 31 (cf. also FIG. 5) is at the bottom in the position of FIG. 15, whereby the two front tongues 30 which serve as an assembly stop extend vertically with their frontal stop faces 39. Rotor 8, and consequently also key 47, is in the key removal rotary position. The bayonet catch between stator 9 and fixed receptacle part 7 is secured against turning back of stator 9, i.e. against detachment, by locking pin 37 engaged in resilient manner in opening 36 in base 28. The downwardly directed solid, i.e. slot-less protective wing 41 of securing member 40 covers the lower collar 35 provided with slot 48 and consequently also the free rear end of locking pin 37, while the upwardly projecting protective wing 42 provided with slot 44 covers the upper collar 35.

According to FIG. 15 (cf. also FIG. 12), the two diametrically facing protective wings 41, 42 are externally provided in each case with a forwardly projecting peripheral shoulder 51 which has a circular segmental cross-section and which extends up to the rear face of base 28 of fixed receptacle 7, and as a result of its shape is adapted to the circular edge of collar 35 which has the same shape. The circular edges of the two collars 35 are located on a common circle, and the circular inner surfaces of peripheral shoulders 51 of the two protective wings 41, 42 are also located on a common circle which is only slightly larger than the common circle of the two collar edges. Thus, securing member 40 with its two protective wings 41 and 42 can be rotated by a full 360° over the two collars 35. However, FIG. 15 also shows that in particular the vertically downwardly projecting collar 35 having the peripheral recess 48 for access to locking pin 47 is covered not only at the rear by the slot-less, i.e. solid protective wing 41, but also at its outer circular peripheral face by the peripheral shoulder 51 of wing 41. Thus, locking pin 37 is neither radially accessible from the side nor from the rear. Thus, with drawers 4 of desk 1 open, a spy cannot even see locking pin 37 and can certainly not reach it, making it impossible for him to without damage replace the original lock 3 by another lock which he has especially prepared.

The legal disassembly of cylinder lock 3 from drawer set 2 of desk 1 (cf. FIG. 1) by an authorized person takes place in the following manner:

Following, unlocking, all the drawers 4 are removed from set 2 in order to provide adequate space within the latter. Then, by means of original key 47, rotor 8 and securing member 40 are rotated by 180°, so that simultaneously the protective wing 42 provided with slot 44 is swung over the lower stator collar 35 provided with recess 48. Locking pin 37 now becomes accessible via the two centrally superimposed recesses 44 and 48 of protective wing 42 and collar 35 located below it. It is now possible to insert an auxiliary tool, e.g. a piece of wire or a correspondingly bent paper clip into said aligned recesses 44 and 48 and by exerting pressure on the rear end of pin 37 with the tool to force the pin back into stator 9, counter to the pressure of pin 38 (cf. FIG. 15), through base recess 36 of fixed receptable part 7 located below collar recess 48. As a result, it is possible to rotate stator 9 in fixed receptacle well part 7 so that it can be turned out of its bayonet catch rotary position together with key 47 and securing member 40 by 90°. Subsequently, lock 3 can be drawn rearwards out of the fixed receptacle 7 through the window opening 31 in base 28 with its two rectangular peripheral recesses 34 (cf. FIG. 5). As the outer contour of the two protective wings 41, 42 corresponds to those of the two collars 35, not only the two collars 35, but also the two wings 41, 42, can be passed through the two window peripheral recesses 44 of base 28 of fixed receptacle 7 either for assembling or diassembling cylinder lock 3.

For dismantling cylinder lock 3, it is sufficient to rotate rotor 8 together with securing member 40 approximately by 90° from its covering rotary position, so that locking pin 37 becomes accessible through the collar opening 48 (cf. FIG. 11) and pin 37 can be forced back into the stator 9 by means of the auxiliary tool inserted into opening 48, after which stator 9 is turned by 90° into its removal rotary position. Subsequently, securing member 40 with its two wings 41, 42 must also be brought into its removal rotary position by a 90° rotation of rotor 8 by means of inserted key 47, if it has also turned during the manual 90° rotation of stator 9.

However, when disassembling the lock the above-mentioned procedure is more advantageous in certain respects, because the insertion of the auxiliary tool into the two aligned superimposed recesses 44 and 48 of protective wing 42 and stator collar 35 provides, together with the correspondingly greater insertion depth, a correspondingly greater guidance length for the auxiliary tool, so that the moving back of locking pin 37 and the subsequent rotation of stator 9 is facilitated. Disassembly is also facilitated in that after moving back the locking pin 37, stator 9 together, i.e. simultaneously, with securing member 40 can be rotated by 90° into the withdrawal rotary position for the lock, whereby during this rotary movement the two stator collars 35 remain covered by the two protective wings 41, 42.

The receptacle for information carriers which are to be kept secret described as an exemplified embodiment with reference to the drawings hereinbefore has in particular the advantage that it renders impossible the standard procedure of professional spies disguised as heating system or telephone engineers to remove the receptable lock unnoticed and, without leaving any visible marks, replace it within a few seconds by a specially prepared lock during the brief absence from the office of the responsible person. It is now also impossible for a spy to raise the locking bars into their unlocking position by inserting a thin metal rod into a small hole made by drilling laterally into the set of drawers or to make the said bars drop into their unlocking position due to their own weight after turning the piece of furniture upside-down. It is also advantageous that these advantages can be obtained with relatively limited expenditure on labour and materials in a relatively simple manner.

Many differences compared with the above embodiment explained relative to the drawing are possible. For example the locking pin located in the stator of the cylinder lock engaged outwardly against the stator collar by a spring also fitted in the stator can be replaced by a pin which engages from the outside, i.e. from the back in the said stator, and which is constructed as a set screw, whereby during the assembly of the cylinder lock it is screwed into the lower stator collar and its front smooth shank engages in a corresponding bore on the rear face of the stator and which is unscrewed again on disassembling the lock prior to rotating the stator out of its locking rotary position. However, such a threaded pin could also be screwed into a threaded bore of the stator after passing through the collar recess.

However, instead of being constructed as security office furniture, the receptacle for the information carrier to be maintained secret could also be in the form of a large area container which could be set up in a factory building where it would be securely anchored to the floor or to a foundation. The reason is that parts of machines, prototypes and even complete machines can constitute information carriers which are frequently subject to espionage. Due to the present competitive business atmosphere, increasing importance is being attached to industrial or economic espionage. However, even international political espionage often relates to weapons and other military objects, so that political espionage is in no way limited to objects stored in office furniture such as e.g. desks, filing cabinets, cupboards containing technical drawings etc.

The present receptacle for information carriers which are to be kept secret need not be a movable, i.e. transportable receptacle. In fact, a complete room may well constitute a receptacle and be used for the secure storage of complete machines, weapons, equipment etc., whereby its door or doors are provided in the manner indicated hereinbefore with a lock secured against unnoticed disassembly.

The above-mentioned cylinder lock could also be replaced by a case lock, whereby e.g. the operating pin of a lock member, which is constructed as a slide and only movable in linear manner by means of the key, engages in a diagonal slot of a vertically movable lock member, and the latter, when extended for locking the lock, covers a locking member or one or more attachment members for the lock.

Thus, the invention is not limited to the embodiment described relative to the drawings hereinbefore, and the construction of the receptacle for information carriers which are to be kept secret can be varied within the scope of the invention.

I claim:

1. A security receptacle, particularly office furniture for storing secret information, with a demountable lock, the receptacle having a stationary portion and a movable portion, the receptacle comprising the combination of a lock having a stator and a rotor, said rotor being movable only by a key belonging to said lock;

means in the stationary portion of the receptacle for receiving said stator, said means including a flat mounting base fixedly attached to said stationary portion, said base having means defining an opening for receiving said stator, said stator having a free-standing collar protruding therefrom, said stator being mountable by insertion of said collar through said opening and rotation of said stator through a predetermined angle;

a releasable catch element for said stator having a blocking position in which said element engages said stationary portion to prevent reverse rotation and removal of said stator, and a release position, said catch element being accessible only from within said receptacle; and a securing member fixedly attached to and movable with said rotor, said securing member comprising a protective wing covering and preventing access to said catch element in both the locked and unlocked key-removal positions of said rotor, said wing being movable to an uncovering position only by rotation of said rotor with its key to a position between the locked and unlocked positions thereof, whereby said lock is demountable from said stationary portion without damage only by using its key.

2. A receptacle according to claim 1, wherein the collar of the stator is provided with a collar recess, said flat mounting base is provided with means defining a first base recess communicating with said opening for receiving said stator, and said catch element comprises a locking pin in the stator displaceably mounted for movement parallel to its longitudinal axis within the central plane of said collar recess and projecting through said first base recess of said flat mounting base under the tension of a spring received in the stator, and engaging resiliently behind said collar, said locking pin, when resiliently engaged in said base recess, being accessible through the collar recess when said protective wing is rotated to its uncovering position, and movable into the stator by an auxiliary tool inserted into the collar recess through the base recess and counter to the tension of the spring, and wherein only after said locking pin has been moved from its locking engagement position in said first base recess of the stationary portion, can the stator be rotated back out of its locking rotary position, the collar recess in the locking rotary position in the stator being positioned in alignment with the base recess of the stationary portion of the receptacle.

3. A receptacle according to claim 2, wherein said flat mounting base includes means defining second and third base recesses diametrically opposite each other, and wherein said stator has on its rear side a second mounting collar which projects radially away from said stator, said two stator collars extending diametrically away from one another in a common plane perpendicular to the stator longitudinal axis and are arranged in free-standing manner on the rear face of said stator, such that the two stator collars, after insertion through said two diametrically opposite base recesses and turning of the stator into its locking rotary position, engage in bayonet catch-like manner behind said flat mounting base said second and third base, recesses for said two stator collars and the first base recess for the locking member being radial extensions of said opening for receiving the stator, such that the remaining peripheral edges thereof are located on a common circle and form centering edges for centering the stator.

4. A receptacle according to claim 3, wherein said rotor includes a second protective wing extending diametrically away from said first protective wing such that, in the key removal rotary position of the rotor, said second protective wing covers the second stator collar, and wherein the two protective wings are arranged on a sleeve-like central portion of a securing member which is common thereto and is connected with a shoulder of the rotor so as to be non-rotatable relative to the latter.

5. A receptacle according to claim 4, wherein the second protective wing has a recess which, after a 180° rotation of the rotor from its key removal rotary position, in which the two protective wings cover the two associated stator collars, is aligned with the recess of the first stator collar which forms the limiting stop for the engagement movement of the locking pin, and wherein after said 180° rotation of the rotor the locking pin resiliently engaged in the base recess of the fixed receptacle part is accessible via the two aligned recesses of the first stator collar and the second protective wing so that, by means of the auxiliary tool inserted into the two aligned recesses, said pin can be moved back through the associated base recess into the stator, the central axis of the base recess for the locking pin being located on a line peripendicular to the common central axis of said second and third base recesses for the two stator collars.

6. A receptacle according to claim 5, wherein said receptacle includes at least one locking bar provided for the receptacle constructed as security office furniture for locking drawers or venetian blind-like closing means, said at least one bar being lockable in the locking position and having an operating pin fixedly attached thereto, and wherein a cam disc is non-rotatably mounted on an operating shaft, said operating pin being in constant engagement with the cam surface of said disc, the shaft being detachably connected with a rotor shoulder of the cylinder lock, said disc having a nose-like projection defining a lifting cam surface on one side thereof and a recess on the other side thereof such that, in the latter part of the locking rotary movement of the cam disc, said projection is positioned over said operating pin with the pin in said recess of said rotary cam disc.

7. A receptacle according to claim 1, wherein said receptacle includes at least one locking bar provided for the receptacle constructed as security office furniture for locking drawers or venetian blind-like closing means, said at least one bar being lockable in the locking position and having an operating pin fixedly attached thereto, and wherein a cam disc is non-rotatably mounted on an operating shaft, said operating pin being in constant engagement with the cam surface of said disc, the shaft being detachably connected with a rotor shoulder of the cylinder lock, said disc having a nose-like projection defining a lifting cam surface on one side thereof and a recess on the other side thereof such that, in the latter part of the locking rotary movement of the cam disc, said projection is positioned over said operating pin with the pin in said recess of said rotary cam disc.

* * * * *